340-870.13 SR
11/30/82 OR 4,361,839

United States Patent [19]
Betterini

[11] 4,361,839
[45] Nov. 30, 1982

[54] CHARGE SOURCE MULTIPLEXING

[75] Inventor: William E. Betterini, Rocky Hill, Conn.

[73] Assignee: United Technologies Corporation, Hartford, Conn.

[21] Appl. No.: 137,141

[22] Filed: Apr. 3, 1980

[51] Int. Cl.[3] ..... G08C 15/06
[52] U.S. Cl. ..... 340/870.13; 370/112; 324/60 C
[58] Field of Search ..... 340/870.13, 870.11, 340/870.16, 870.37, 870.04; 324/60 C, 60 CD; 73/780, 724; 318/662; 323/93, 352, 370, 271, 288; 370/112, 114

[56] References Cited

U.S. PATENT DOCUMENTS

| | | | |
|---|---|---|---|
| 3,750,155 | 7/1973 | Oman | 340/870.13 |
| 3,909,811 | 9/1975 | Adler | 340/870.13 |
| 4,005,273 | 1/1977 | Siems | 340/870.13 |
| 4,056,686 | 11/1977 | Zielinski | 340/870.13 |

*Primary Examiner*—John W. Caldwell, Sr.
*Assistant Examiner*—Donnie Lee Crosland
*Attorney, Agent, or Firm*—Dominic J. Chiantera

[57] ABSTRACT

A charge-mode signal conditioning interface includes a charge-mode signal multiplexer for providing a low impedance series path for the output charge signals from each charge source to the input of the common charge amplifier, one at a time in each sample time interval of a repetitive sequence of sample time intervals and non-sample time intervals for each source, and for providing a low impedance shunt path for each charge source in each non-sample interval.

3 Claims, 3 Drawing Figures

CHARGE SOURCE MULTIPLEXING

DESCRIPTION

1. Technical Field

This invention relates to signal multiplexing, and more particularly to multiplexing of charge signals from a plurality of charge sources into a common charge amplifier.

2. Background Art

Piezoelectric transducers are known in the art for providing an output signal at a magnitude proportional to the force applied to the transducer by an external source, such as a sensed ambient parameter. The piezoelectric transducer can be considered electrically equivalent to a small capacitor which produces an output charge signal Q (coulombs) across its plates, at a magnitude proportional to the change in capacitance produced by the external force. The transducer open circuit output voltage ($E_O$) is equal to the generated charge (Q) divided by the instant capacitance value, or $E_O=(Q/C_O)$.

Although the output voltage may be used as the signal manifestation of the sensed parameter, i.e. voltage-mode operation, the voltage magnitude is attenuated by the capacitance of the interconnecting lines between the transducer and its signal conditioning interface. With long line lengths the attenuation may be enough to produce an undesirable signal-to-noise ratio. Also with voltage-mode operation, the low frequency response of the signal conditioning interface is a function of the RC time constant of the piezoelectric transducer, the interconnecting lines, and the input impedance of the voltage amplifier used in the signal conditioning interface. On the other hand, the output charge signal magnitude ($Q=C_O\times E_O$) is unaffected by the capacitance of the interconnecting lines due to the attenuation of the output voltage signal. Similarly the low frequency response of the charge-mode interface is determined only by the charge amplifier characteristics; RC time constant considerations do not apply. This is important in vibration sensing applications where low frequency vibration levels are of the most interest due to the corresponding high magnitudes of displacement which accompany the low vibration frequencies. The most extensive use of charge-mode operation is found in signal conditioning interfaces for use with vibration accelerometers.

The prior art charge-mode signal conditioning interfaces require the use of a dedicated charge amplifier for each transducer. Signal multiplexing of the output charge signals from a plurality of transducers into a single charge amplifier, i.e. time division multiplexing, has not been practical due to two characteristics of the conventional multiplexer switching interface. These include the feed through capacitance associated with the multiplexer (MUX) series switches when they are turned off, and the high impedance (open circuit) termination of the interconnecting line with the MUX series switch off. The feed through capacitance provides capacitive coupling of the non-sampled charge signal around the switch. As a result there is signal coupling from the off channels into the charge amplifier, producing errors in the resultant output signal. The high impedance termination of the off channels may cause large charge buildups on the interconnecting line between the charge source sensor and the charge amplifier which when sampled can overdrive or saturate the signal conditioning interface. The errors due to both the capacitive feed through and charge buildup may result in input charge signal levels of much greater magnitude than that of the actual vibration signal itself. As a result, the classical signal conditioning interface for charge-mode operation has been the use of dedicated signal conditioning charge amplifiers for each source. This results in greater circuit components for the interface, but more importantly it results in a gain mismatch between the sensed inputs due to differences in tolerance between individual charge amplifiers.

DISCLOSURE OF INVENTION

One object of the present invention is to provide a charge-mode signal conditioning interface having signal multiplexing, whereby a common signal conditioning charge amplifier is used to provide analog equivalent signals for the output charge signals from each of a plurality of charge sources. Another object of the present invention is to provide a high accuracy charge-mode signal conditioning interface, with known signal conversion tolerances.

According to the present invention, a charge-mode signal conditioning interface includes a charge-mode signal multiplexer for providing a low impedance series path for the output charge signals from each charge source to the input of the common charge amplifier, one at a time in each sample time interval of a repetitive sequence of sample time intervals and non-sample time intervals for each source, and for providing a low impedance shunt path for each charge source in each non-sample interval. In further accord with the present invention, the charge-mode signal multiplexer includes a plurality of channels, one associated with each charge source, each channel having a pair of switches including a series switch connected between one output of the associated source and the input to the common charge amplifier and including a shunt switch connected across the two outputs of the associated source, the switches in each channel being alternately set in a low impedance state and a high impedance state in response to a related one of a pair of gate signals presented to each channel from a gate signal source, the gate signal source providing each channel with alternate pairs of sample gate signals and non-sample gate signals corresponding to the sample time intervals and non-sample time intervals for the charge source associated therewith, the series switch being set in a low impedance state and the associated shunt switch being set in a high impedance state in response to each pair of sample gate signals, the series switch being set to a high impedance state and the associated shunt switch being set to a low impedance state at all other times. In accordance with another aspect of the present invention, the charge-mode signal conditioning interface further includes a source of reference charge signals having a selected charge signal magnitude, the charge-mode signal multiplexer further including a reference signal channel having a series switch connected between one output of the reference charge source and the input of the common charge amplifier and a shunt switch connected across the outputs of the reference charge source, the switches in the reference channel being responsive to a pair of calibration gate signals presented from the gate signal source in the presence of non-sample gate signals presented to each other channel of the multiplexer, each pair of calibration gate signals setting the series switch in a low impedance state and the shunt switch in a high impedance state, thereby providing a high transmissive path for the reference charge signals to the input of the common charge amplifier, the series switch being set in a high impedance state and the shunt switch being set in a low impedance state at all other times, whereby the reference charge signals presented to the charge amplifier in the presence of the calibration gate signals provide a manifestation of the signal tolerances of the charge amplifier.

The charge-mode signal conditioning interface of the present invention permits charge signal multiplexing from a plurality of charge sources into a common charge amplifier, thereby minimizing the channel-to-channel gain offset errors present in prior art interfaces having individual charge amplifiers for each source. The present multiplexing interface minimizes feed through errors between input channels by providing a low impedance termination to each charge source during the non-sample time interval. The low impedance shunt termination further eliminates the charge buildup on the interconnecting lines between the source and common charge amplifier. In addition, a built-in source of calibrated charge signals is selectably multiplexed into the charge amplifier, the reference charge signals having a known signal magnitude for providing calibration and determination of charge amplifier signal tolerances, thereby minimizing the signal conversion errors associated with providing the analog equivalent signal of the input charge signal magnitude.

These and other objects, features and advantages of the present invention will become more apparent in light of the following detailed description thereof, as illustrated in the accompanying drawing.

BEST MODE FOR CARRYING OUT THE INVENTION

Figure 1:
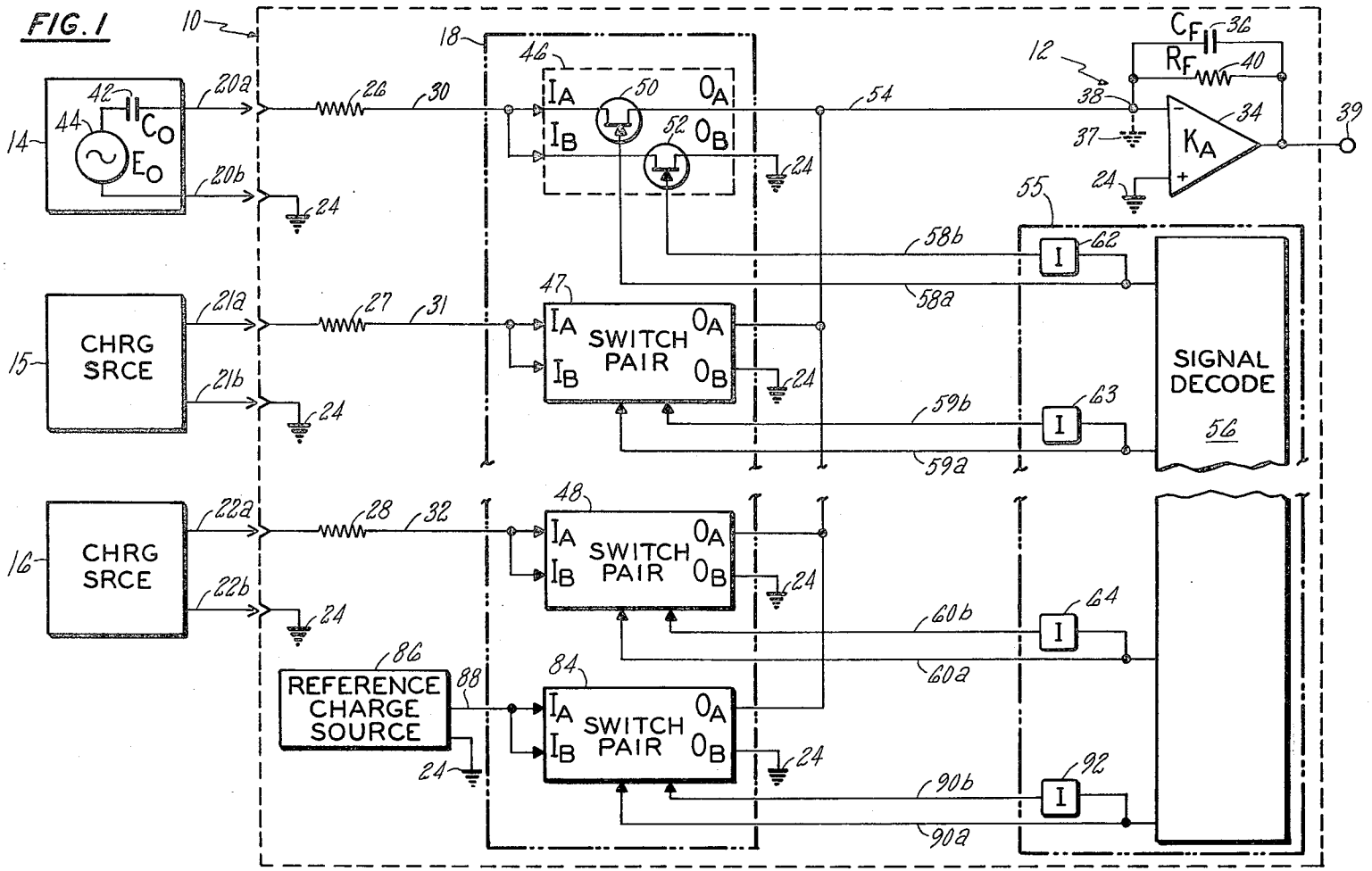
FIG. 1 is a simplified schematic diagram of a charge source signal conditioning interface according to the present invention.

Referring now to FIG. 1, in the charge source signal conditioner (CSSC) 10 of the present invention a charge amplifier 12 receives the output charge signals from each of a plurality of charge sources 14 through 16 through a charge-mode multiplexer (MUX) 18. As used here the term charge source is a generic term for describing all types of piezoelectric transducers operated in the charge-mode, including the accelerometer vibration sensors described hereinbefore. The sources each provide the charge signal output through pairs of lines $20_a$, $20_b$ through $22_a$, $22_b$ to the signal conditioner 10. Within the signal conditioner one output line from each source ($20_b$ through $22_b$) is connected to a common signal bus, or signal ground 24, and each of the other output lines ($20_a$ through $22_a$) are connected through current limiting resistors 26 through 28 and lines 30 through 32 to a related one of a plurality of channels of the charge-mode MUX 18.

The charge amplifier circuit 12 is of a type known in the art, which typically includes a high gain FET operational amplifier 34, such as the National Semiconductor LF156, strapped down in a closed loop with negative capacitance feedback provided by capacitor $C_F$ 36 to provide a virtual ground 37 at the amplifier summing junction 38. The capacitor, which is typically ceramic, has low current leakage and low temperature coefficient characteristics. The charge amplifier provides an analog voltage equivalent signal ($V_O$) on an output line 39 which is proportional in magnitude to the input charge (Q) at the summing junction by the gain transfer function: $V_O=(Q/C_F)$. The charge amplifier also includes a feedback resistor ($R_F$) 40 which provides a bias current return path for the amplifier.

As known, the simplified equivalent circuit for the charge sources 14–16 includes a charge generator providing the charge signal $Q_O$ in parallel with a capacitor $C_O$; the open circuit A.C. output voltage being equal to $E_O=(Q_O/C_O)$. Alternately the Thevenin equivalent circuit may be used to simplify analysis, which as shown for the source 14 includes the capacitor $C_O$ 42 in series with an A.C. voltage source 44 which ideally provides a sinusoidal output $E_O=E\ \mathrm{Sin}(wt+\phi)$. The output voltage $E_O$ represents the excitation signal magnitude and frequency for the source, with the output charge signal magnitude being equal to $Q_O=C_O \cdot E_O$.

The MUX includes pairs of signal switches 46–48, one pair associated with each of the charge sources 14–16. Each switch pair includes two bilateral FET switches, schematically illustrated for the switch pair 46 by P-channel FET switches 50, 52. The simplified P-channel illustration of the bilateral FET switches is intended only to simplify the illustration of the signal conditioner, and also the description of the function of the switch. Each, however, is a bilateral switch which, as may be known, includes both a P-channel and an N-channel FET device together with associated FET control circuitry within the switch to allow bidirectional current conduction and low on resistance between the source and drain when gated on. The switches are of the type known in the art for use in analog switching, or multiplexing applications, such as the RCA COS/MOS Bilateral Switch Series CD4066. In the present invention the bilateral characteristic is required to assure equal current conduction in both directions due to the alternating current (AC) input signal from the charge source, and to ensure a low ON impedance.

The bilateral FET switches in each pair are connected in a series and shunt configuration, as illustrated for the pair 46. The series switch 50 is connected between the input line 30 from the source 14 and a MUX output signal line 54 connected to the summing junction 38 of the charge amplifier. The shunt switch 52 is connected between the input line 30 and the common signal ground 24. The ON/OFF state of the switches in each pair are complementary, one being turned on while the other is off, and the signal state of the pairs of switches is multiplexed to allow only the series switch in one channel, i.e. the channel presently sampled, to be turned on while the series switches in the remaining channels are turned off. In other words the signal state of the switches in each pair are complementary and the signal state of the switch pair of the presently sampled channel is complementary to the signal state of the remaining switch pairs. This complementary switch control is provided through sequential complementary gate signals, i.e. MUX address signals, provided to each channel switch pair from the MUX address control circuitry 55. The MUX control circuitry, which may be included as a part of a control microprocessor used in the parent data acquisition system, provides each pair of complementary gate signals as a TRUE signal and its $\overline{\text{TRUE}}$ complement. In FIG. 1 the MUX address control is illustrated simply as a signal decode 56 which provides a plurality of TRUE output gate signals on lines $\mathbf{58}_a$ through $\mathbf{60}_a$ to one of the series FET switches in an associated one of the switch pairs 46 through 48, and to a related one of a plurality of INVERT GATES 62 through 64. The inverted true signals ($\overline{\text{TRUE}}$) from each gate are presented through lines $\mathbf{58}_b$ through $\mathbf{60}_b$ to the shunt FET switches in each related switch pair.

Figure 2:
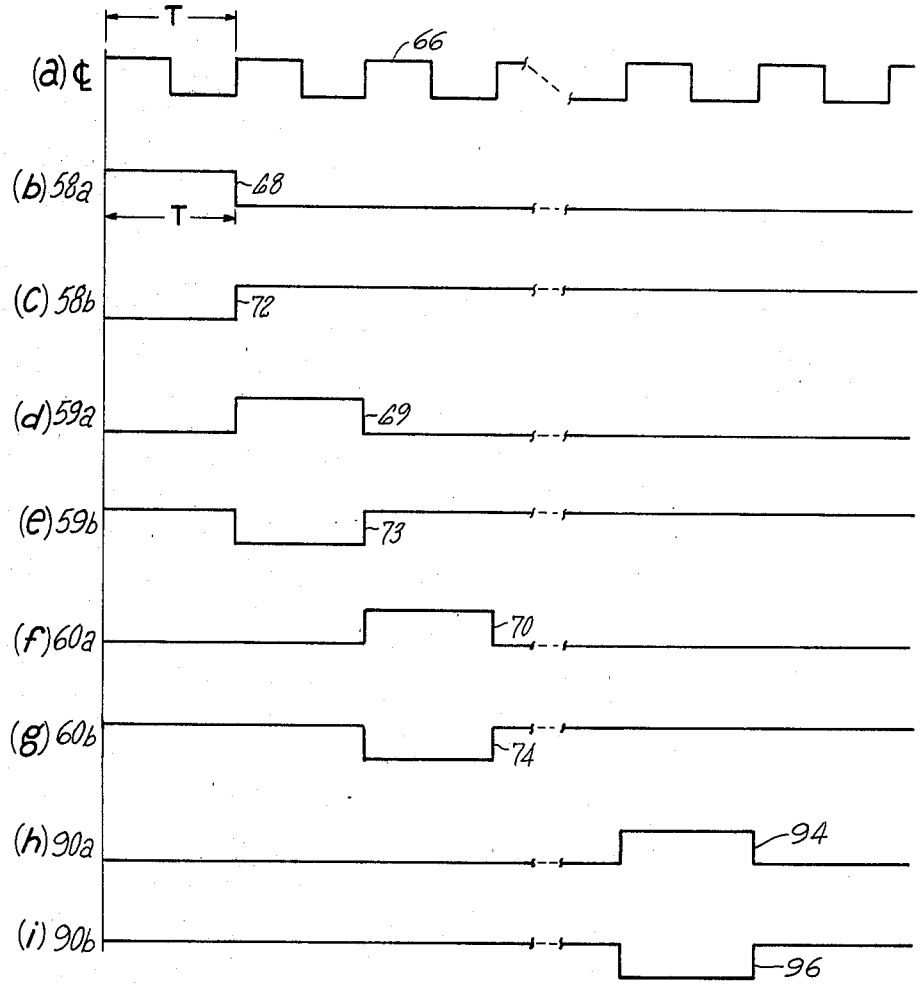
FIG. 2 is an illustration of waveforms used in the description of the embodiment of FIG. 1.

For the decode 56 with a clock signal of period T, the sequenced TRUE and $\overline{\text{TRUE}}$ signals on the lines $\mathbf{58}_a$, $\mathbf{58}_b$ through $\mathbf{60}_a$, $\mathbf{60}_b$ are illustrated in FIG. 2. Illustration (a) represents the clock signal 66 presented to the decode with the period T establishing the sample time interval for each charge source, and illustrations (b), (d), and (f) represent the $\overline{\text{TRUE}}$ signals 68–70 provided on the lines $\mathbf{58}_a$–$\mathbf{60}_a$ respectively. Illustrations (c), (e), and (g) show the complement TRUE signals 72–74 from the INVERT GATES 62–64 on lines $\mathbf{58}_b$–$\mathbf{60}_b$ respectively. As shown only one series switch is turned on and one shunt switch (the associated one of the pair) is turned off at any given time, that being the one associated with the presently sampled channel; all of the remaining series switches are turned off simultaneously with the turning on of the associated shunt switch in each pair, thereby providing a low signal impedance path for the charge source in each non-sampled channel.

The low impedance shunt path presented by the turned on shunt switches provides attenuation of the charge output signal ($Q_O$) from each non-sampled source in proportion to the ratio of the shunt switch on impedance to the output impedance of the source. Since the charge source is capacitive, the output impedance is dependent on the excitation frequency of the source. In other words the absolute magnitude of attenuation is dependent on the particular type charge source, i.e. application dependent. However, in any charge application the output impedance of the source is so much greater than that of the switch that the error arising from the capacitive coupling of the attenuated signal to the summing junction of the charge amplifier is insignificant.

Figure 3:
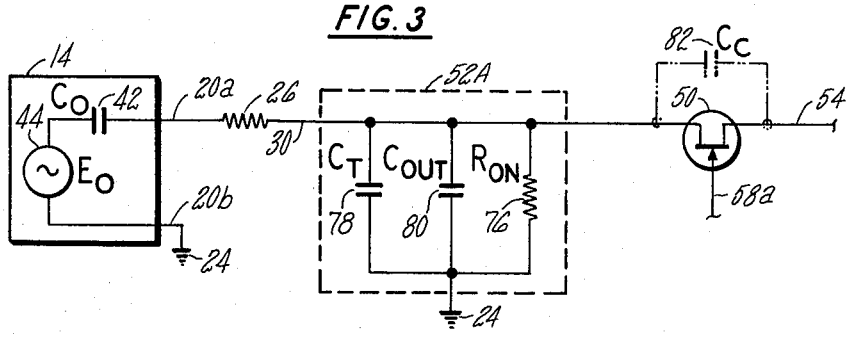
FIG. 3 is a schematic illustration of a detail of the embodiment of FIG. 1.

To illustrate, in the case of vibration acceleration sensors, their typical output scale factor is on the order of 10 pico-coulombs per peak G level of acceleration. For a typical max G level range of interest on the order of fifty the maximum output charge signal magnitude is 500 pico-coulombs, and for a typical sensor capacitance (Co) of 500 pico-farads the equivalent open circuit output voltage ($E_o=(Q_o/C_o)$ is one volt. In FIG. 3, which illustrates the interface between the charge source 14 and its associated MUX channel 46 in a non-sample interval, the equivalent ON circuit 52A for the shunt switch 52 is shown as including an ON resistance 76 in parallel with the junction capacitance ($C_T$) 78 and output capacitance ($C_O$) 80 of the switch. The total shunt capacitance ($C_T+C_O$) is less than 10 pico-farads and the worst case maximum ON resistance value is 500 ohms. For an assumed source excitation frequency of 100 Hz the output impedance of the source is approximately 3.0 Megohms and the attenuating gain of the shunt switch and source output impedance is on the order of 0.00017 volts-per-volt. The coupling capacitance ($C_C$) 82 (shown in phantom) around the series switch 50 (which is OFF) includes the sum of the switch junction capacitance and the stray capacitance associated with the printed circuit board mounting. The actual charge signal coupled through to the MUX output line 54 (the input to the charge amplifier) is $Q_C=(0.00017)E_O \cdot C_C$. If $C_C=10$ pico-farads the coupled signal is equal to 0.0017 pico-coulombs, or 0.00034% of the maximum 500 pico-coulomb input. Although this error itself is insignificant, the typical ON impedance of the FET shunt switch is on the order of one-fifth the assumed worst case value, such that for all practical purposes the resultant charge error signal coupled across the off FET series switch is nonexistent. In other words the present charge source signal conditioner provides absolute signal rejection between input channels thereby eliminating any cross-talk effect. In addition, the low impedance shunt of each charge source in the non-sample interval eliminates any potential for charge buildup on the interconnecting lines, such that both prior art limitations on the use of signal multiplexing in a charge-mode interface are eliminated.

In the present charge source signal conditioner the common charge amplifier eliminates the gain offset error present in the prior art interfaces where individual amplifiers are used for each source. Instead there is a common charge conversion signal tolerance for all of the input sources. In the present signal conditioner the contribution of the charge amplifier tolerance to the total conversion signal tolerance is eliminated by multiplexing one or more reference charge signals into the amplifier, each having a known magnitude, such that the charge amplifier tolerances may be calibrated out in the analog equivalent signal. This is provided in the embodiment of FIG. 1 by the addition of another channel pair of switches 84 to the MUX 18, which are identical to the other channel switch pairs. A reference charge signal source 86 which includes a calibrated voltage source and precision capacitor, provides one, or more, reference charge signals between the line 88 and ground 24 to the switch pair. The switches receive a pair of complementary, calibration gate signals on lines $\mathbf{90}_a$, $\mathbf{90}_b$ from the MUX address signal source 55. As with the gate signals provided to the charge source channels these gate signals are provided as a TRUE signal 94 (FIG. 2, illustration (h) from the decode 56 and the $\overline{\text{TRUE}}$ complement 96 (FIG. 2, illustration (i)) from an INVERT GATE 92. This allows the reference charge source signal to be multiplexed into the charge amplifier at any time; as another sampled input within each sample cycle period together with the sampled signals from the charge sources, or a periodically, once in each operational period to provide an initial calibration reference. The known magnitude reference signal ideally, in the absence of amplifier tolerances, produces a known magnitude analog equivalent signal. Any deviation in analog signal magnitude can be attributed to the charge amplifier tolerances and accounted for in the sampled charge signals by signal processing downstream of the charge amplifier. This eliminates the charge amplifier tolerances and provides an essentially zero signal conversion error; the actual errors in the sensed signal data being attributable to the charge sources themselves.

In the charge source signal conditioner of the present invention, the use of the series/shunt switching of the charge output signals from each of the plurality of sampled charge sources allows for the use of a single, common charge amplifier for a plurality of charge sources. This provides not only for the reduction in circuitry over that required in the prior art charge-mode interfaces, but also allows for the minimizing of the gain offset error signal between the sampled charge output signals from the different sources. The reduction in the gain offset error is significant in vibration sensing applications in which the relative displacement of components in a common assembly are to be determined. Specifically, the use of vibration sensors to monitor engine vibration in both military and commercial aircraft where the sensed vibration of the major engine components are monitored to allow for prognosis of engine performance, or diagnosis of engine failure. The use of a reference charge signal which may be selectably multiplexed into the charge amplifier allowing for calibration and determination of actual amplifier tolerances, virtually eliminates any signal conversion error. This reduces the actual sensed tolerances for each sampled signal, and provides a built-in test feature for continuously establishing the integrity of the interface.

Similarly, although the invention has been shown and described with respect to a best mode embodiment thereof, it should be understood by those skilled in the art that the foregoing and various other changes, omissions and additions in the form and detail thereof may be made therein without departing from the spirit and the scope of the invention.

We claim:

1. A charge source signal conditioner for providing an analog signal manifestation of the charge signals from a plurality of charge sources, comprising:

charge amplifier means, for converting the charge magnitude of each charge signal presented at an input thereof into a selectable, equivalent magnitude analog signal provided at an output thereof; and charge-mode signal multiplexer means, for providing a low impedance series signal path for the charge signals from each source to said input of said charge amplifier means, one at a time, in a related charge source sample time interval from a repetitive sequence of alternating sample time intervals and non-sample time intervals for all of the charge sources, said multiplexer means providing a low impedance shunt signal path to the output signals of each charge source at all other times.

2. The charge-mode signal conditioner of claim 1, wherein said multiplexer means includes a plurality of channels, one associated with each charge source, each channel including a series switch connected between the output of the associated source and said input of said charge amplifier means and including a shunt switch connected across the outputs of the associated source, said switches in each channel being oppositely set, alternately, in a low impedance state and a high impedance state in dependence on the presence and absence of a pair of sample gate signals presented thereto in each of the associated source sample time intervals, said series switch being set in a low impedance state and the associated shunt switch being set in a high impedance state in the presence of said pair of sample gate signals, the series switch being set to a high impedance state and the associated shunt switch being set to a low impedance state at all other times.

3. The charge-mode signal conditioner of claim 2, further comprising:

reference signal source means, for providing reference charge signals having a corresponding, known reference analog signal magnitude at the output of said charge amplifier means, and wherein said multiplexer means further includes a reference signal channel having a series switch connected between said reference signal source means output and said input of said charge amplifier means and having a shunt switch connected across the outputs of said reference signal source means, each alternately set in a low impedance state and a high impedance state, said reference channel series switch being set in a low impedance state and said reference channel shunt switch being set in a high impedance state in the presence of calibration gate signals presented thereto in the absence of said sample gate signals presented to each other channel of said multiplexer, for providing to said amplifier means said known reference analog signal magnitude, said reference channel series switch being set in a high impedance state and said shunt switch being set in a low impedance state at all other times.

* * * * *

UNITED STATES PATENT AND TRADEMARK OFFICE

CERTIFICATE OF CORRECTION

PATENT NO. : 4,361,839

DATED : November 30, 1982

INVENTOR(S) : William E. Betterini

It is certified that error appears in the above-identified patent and that said Letters Patent is hereby corrected as shown below:

| | |
|---|---|
| Column 5, line 18 | "$\overline{\text{TRUE}}$" should be "TRUE" |
| Column 5, line 20 | "TRUE" should be "$\overline{\text{TRUE}}$" |
| Column 5, line 40 | After "charge" insert --source-- |

Signed and Sealed this

*Thirty-first* Day of *July 1984*

[SEAL]

*Attest:*

GERALD J. MOSSINGHOFF

*Attesting Officer*

*Commissioner of Patents and Trademarks*